US006027368A

United States Patent [19]

Daoud

[11] Patent Number: 6,027,368

[45] Date of Patent: Feb. 22, 2000

[54] CONNECTOR ASSEMBLY HAVING A UNIVERSAL MOUNTING BRACKET

[75] Inventor: Bassel Hage Daoud, Parsippany, N.J.

[73] Assignee: Lucent Technologies, Inc., Murray Hill, N.J.

[21] Appl. No.: 09/050,325

[22] Filed: Mar. 30, 1998

[51] Int. Cl.[7] ..... H01R 13/60

[52] U.S. Cl. ..... 439/532

[58] Field of Search ..... 439/532, 533, 439/716, 719, 720, 727, 210, 709, 710–715; 174/138 G, 138 D, 72 A; 361/742, 770, 767, 807, 808

[56] References Cited

U.S. PATENT DOCUMENTS

| | | | |
|---|---|---|---|
| 4,390,230 | 6/1983 | Knickerbocker | 439/711 |
| 4,775,324 | 10/1988 | Norden | 439/709 |
| 5,608,611 | 3/1997 | Szudarek et al. | 361/753 |
| 5,800,187 | 9/1998 | Vermon et al. | 439/92 |
| 5,825,635 | 10/1998 | Mukoyama et al. | 361/826 |

*Primary Examiner*—Lincoln Donovan

*Attorney, Agent, or Firm*—Gibbons, Del Deo, Dolan Griffinger & Vecchione

[57] ABSTRACT

An assembly for mounting terminal array connectors to a surface. The assembly includes a generally planar bracket having a first surface and a second surface. A plurality of apertures are formed through the bracket, wherein the apertures include wire apertures, screw apertures and anchor apertures. One or two wire connectors are affixed to the bracket, wherein each side of the bracket is capable of supporting one wire connector. At least one spacer is disposed between the bracket and each wire connector that it supports. The spacers prevent each wire connector from contacting bracket and shorting against the material of the bracket. The wire connectors and spacers are affixed to the bracket by at least one mechanical fastener. The mechanical fasteners extend through the screw apertures in the bracket and the spacers, wherein the mechanical fasteners engage the body of the wire connector being mounted.

17 Claims, 4 Drawing Sheets

CONNECTOR ASSEMBLY HAVING A UNIVERSAL MOUNTING BRACKET

RELATED ARPLICATIONS

This application is related to the following:

U.S. patent application Ser. No. 09/050,510, entitled IMPROVED SPLICE CHAMBER AND CONNECTOR ASSEMBLY FOR BUILDING ENTRANCE PROTECTORS, filed Mar. 30, 1998, which is herein incorporated into this disclosure by reference.

BACKGROUND OF THE INVENTION

1. Field of the Invention

The present invention relates to terminal array connectors of the type commonly used to join telecommunication lines at a junction point. More particularly, the present invention relates to systems and methods for utilizing telecommunication line connectors in a dense, space efficient manner.

2. Description of the Prior Art

In the field of telecommunications equipment, there are many different types of connectors that are used to interconnect copper telephone lines at junction points. In applications where numerous telephone lines are present, a common type of connector used is a terminal array connector, such as the model S 66 M connector manufactured by the Siemens Company. Terminal array connectors have an array of slot terminals on their top surface and an array of post terminal on their bottom surface. A first set of copper telephone lines are connected to the bottom post terminals at known position addresses. A second set of copper telephone lines are then selectively connected to the slot terminals on the top of the connector. By connecting the second set of telephone wires to different positions on the terminal array connector, most any desired interconnection can be made between the first set of telephone wires and the second set of telephone wires.

There are many junction points in a telephone wiring system where terminal array connectors can be used. Often the junction point for telecommunication lines is a utility room in the cellar of a building. Within a utility room, terminal array connectors are often mounted side-by-side on a panel on one of the walls of the utility room. Alternatively, often the junction point is contained within a junction box, such as a building entrance protector. The application of building entrance protectors is described in related U.S. patent application Ser. No. 09/050,510, entitled Improved Splice Chamber And Connector Assembly, which is assigned to Lucent Technologies, the assignee herein and which is incorporated into this disclosure by reference.

When terminal array connectors are used in junction boxes or when terminal array connectors are mounted on a wall, the amount of space available is limited. The number of terminal array connectors used in a given application depends upon the number of telephone lines being used. The more telephone lines that are being used at a particular location, the more terminal array connectors are needed to join those telephone lines. As often is the case, the number of telephone lines used at one location surpasses the space available for the terminal array connectors needed to join those telephone lines. The telephone wire must then be rerouted to different utility rooms or other locations where enough space for the terminal array connectors is available.

A need therefore exists for a manner of improving the density at which terminal array connects can be mounted, thereby increasing the number of terminal array connectors that can be mounted in a given size space.

SUMMARY OF THE INVENTION

The present invention is an assembly for mounting terminal array connectors to a surface. The assembly includes a generally planar bracket having a first surface and a second surface. A plurality of apertures are formed through the bracket, wherein the apertures include wire apertures, screw apertures and anchor apertures. One or two wire connectors are affixed to the bracket, wherein each side of the bracket is capable of supporting one wire connector.

At least one spacer is disposed between the bracket and each wire connector that it supports. The spacers prevent each wire connector from contacting the bracket and shorting against the material of the bracket. The wire connector(s) and spacers are affixed to the bracket by one or more mechanical fasteners. The mechanical fasteners extend through the screw apertures in the bracket and the spacers, wherein the mechanical fasteners engage the body of the wire connector being mounted.

BRIEF DESCRIPTION OF THE DRAWINGS

For a better understanding of the present invention, reference is made to the following description of an exemplary embodiment thereof, considered in conjunction with the accompanying drawings, in which.

DETAILED DESCRIPTION OF THE DRAWINGS

Figure 1:
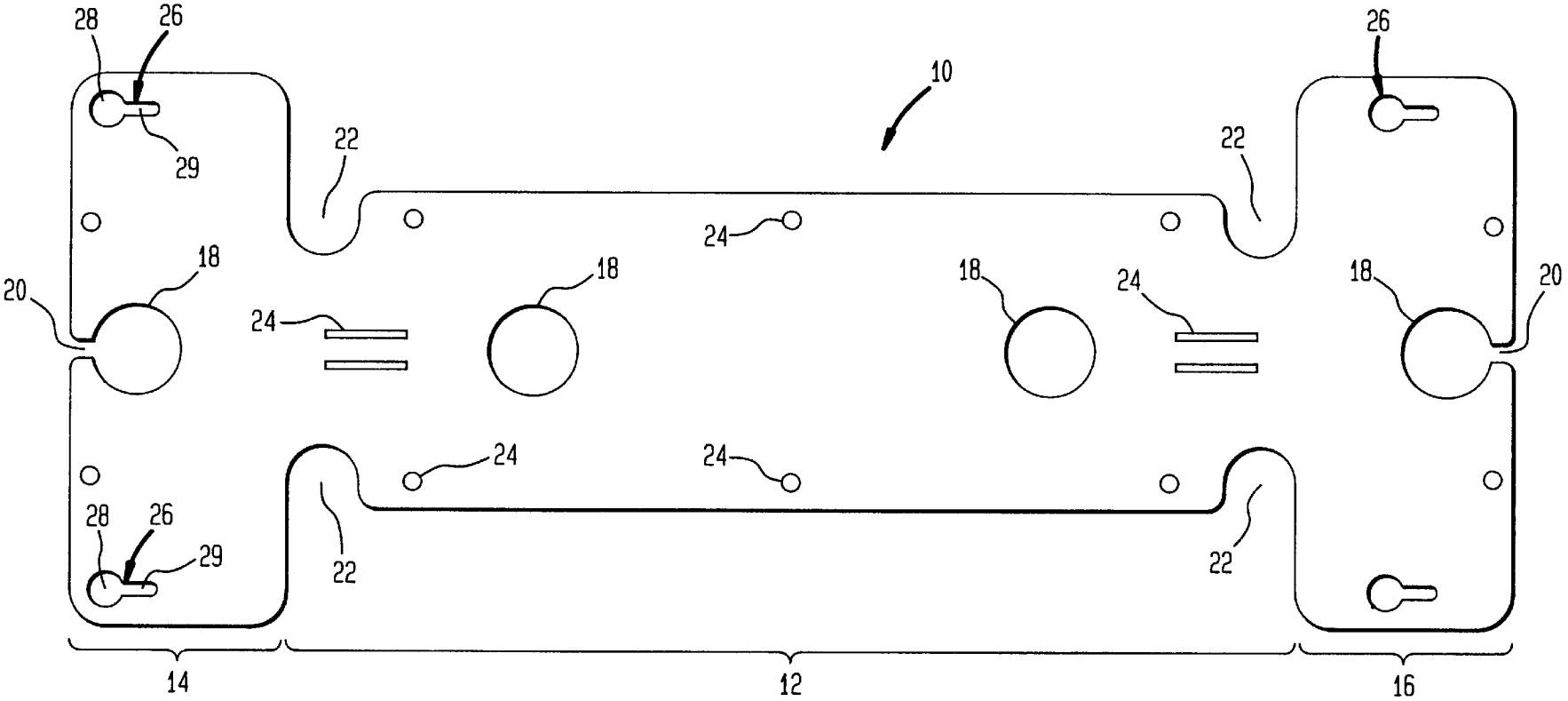
FIG. 1 is a pan view of an exemplary embodiment of a bracket used as part of the present invention assembly.

Referring to FIG. 1, there is shown a top view of a bracket 10 which is to be used in the present invention assembly. The bracket 10 is preferably a generally planar structure that can either be stamped out of metal or molded from plastic. If stamped from metal, all the edges of the stamping should either be folded over or rounded. This would prevent and stamped edge from being sharp and being able to cut through the insulation of any wire that may contact that stamped edge.

In the shown embodiment, the bracket 10 is generally I-shaped having a thinner mid-section 12 positioned between a wider top section 14 and bottom section 16. A series of wire apertures 18 are disposed down the center of the bracket 10. The wire apertures 18 that are proximate the left and right edges of the bracket 10 are accessible by access slots 20. The access slots 20 enable wires to be passed into these wire apertures 18 without the ends of the wire having to be free. Semicircular reliefs 22 are disposed at the junction points between the mid-section 12 of the bracket 10 and both end sections 14, 16 of the bracket 10. The semicircular reliefs 22 preferably have the same radius of curvature as does the wire apertures 18 along the center of the bracket.

Tie hoops 24 are formed in the body of the bracket at points proximate the wire apertures 18. The tie hoops 24 provide a structure through which a cable tie (not shown) can be attached. The tie hoops 24 are positioned proximate both the wire apertures 18 and the semicircular reliefs 22 so that cable ties can be used to bind any groupings of wires that may pass through these structures.

Screw apertures 24 are disposed at various points along the periphery of the bracket 10. The screw apertures 24 align with different mounting points on different models of terminal array connectors. Additionally, four slotted apertures 26 are formed through the bracket 10 at points proximate the four corners of the bracket 10. The slotted apertures 26 have an enlarged head region 28 and a narrow neck region 29 that extends away from the enlarged head region 28.

Figure 2:
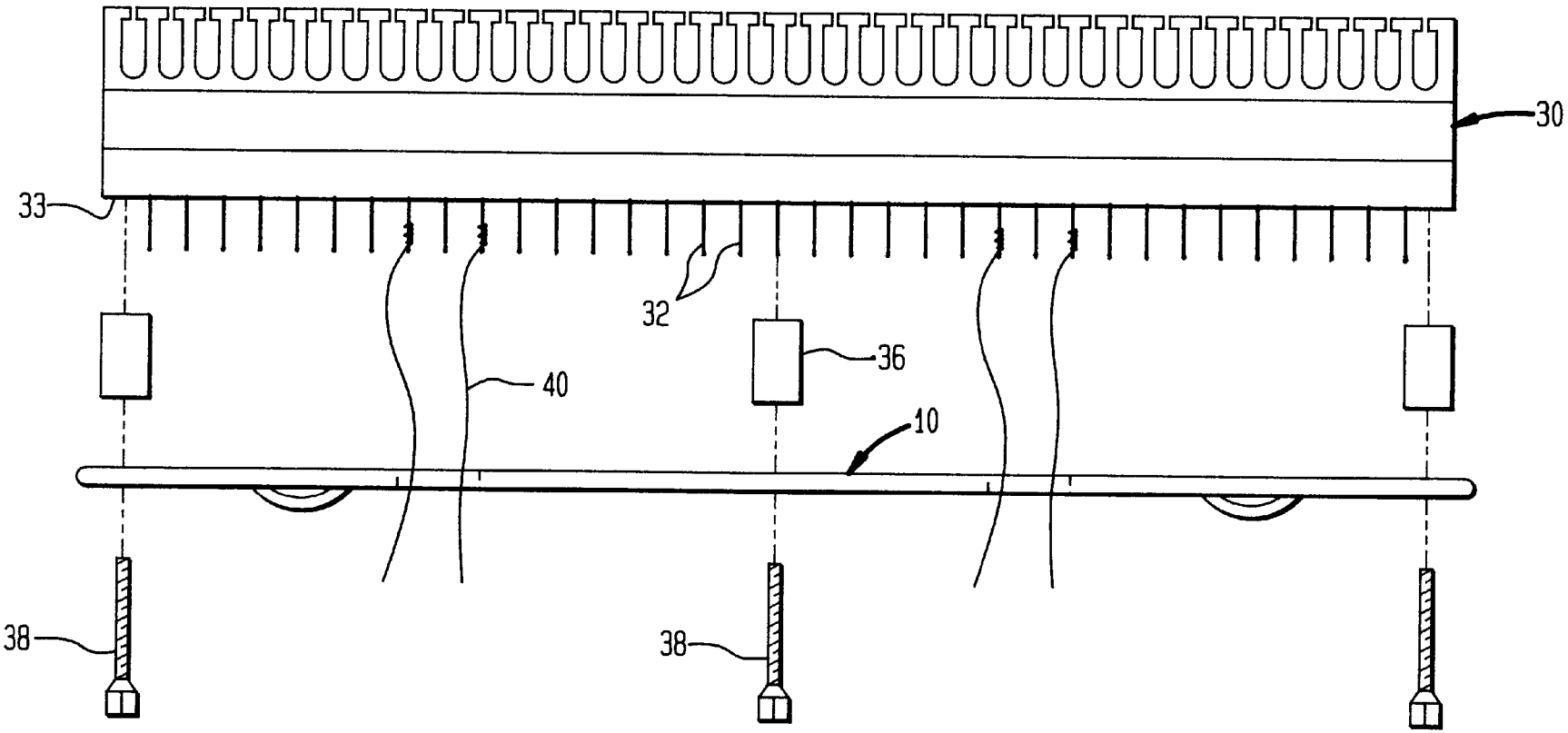
FIG. 2 is a side exploded view of a connector-bracket assembly in accordance with the present invention.

Referring to FIG. 2, a typical terminal array connector 30 is shown. The terminal array connector 30 contains an array of post terminals 32 that extend from its bottom surface 33. The post terminals extend through the body of the terminal array connector 30 and terminate with an array of slotted terminals (not shown) on the top surface of the terminal array connector 30. The bracket 10 is affixed to the bottom surface 33 of the terminal array connector 30. The bracket 10 is supported a predetermined distance away from the bottom surface 33 of the terminal array connector 30 by dielectric spacers 36. In this manner, the various post terminals 32 extending from the bottom surface 33 of the terminal array connector 30 do not contact and short against the bracket 10.

The bracket 10 mounts to the terminal array connector 30 by mounting screws 38 that pass through both the screw holes 24 (FIG. 1) in the bracket 10 and the dielectric spacers 36. The mounting screws 38 engage preexisting threaded bores (not shown) that are manufactured into the structure of the terminal array connector 30.

Wires 40 attach to the post terminals 32 on the bottom surface 33 of the terminal array connector 30. The wires 40 is pass through the bracket 10 by either passing through one of the wire apertures 18 (FIG. 1) or one of the semicircular reliefs 22 (FIG. 1) defined by the bracket 10.

Figure 3:
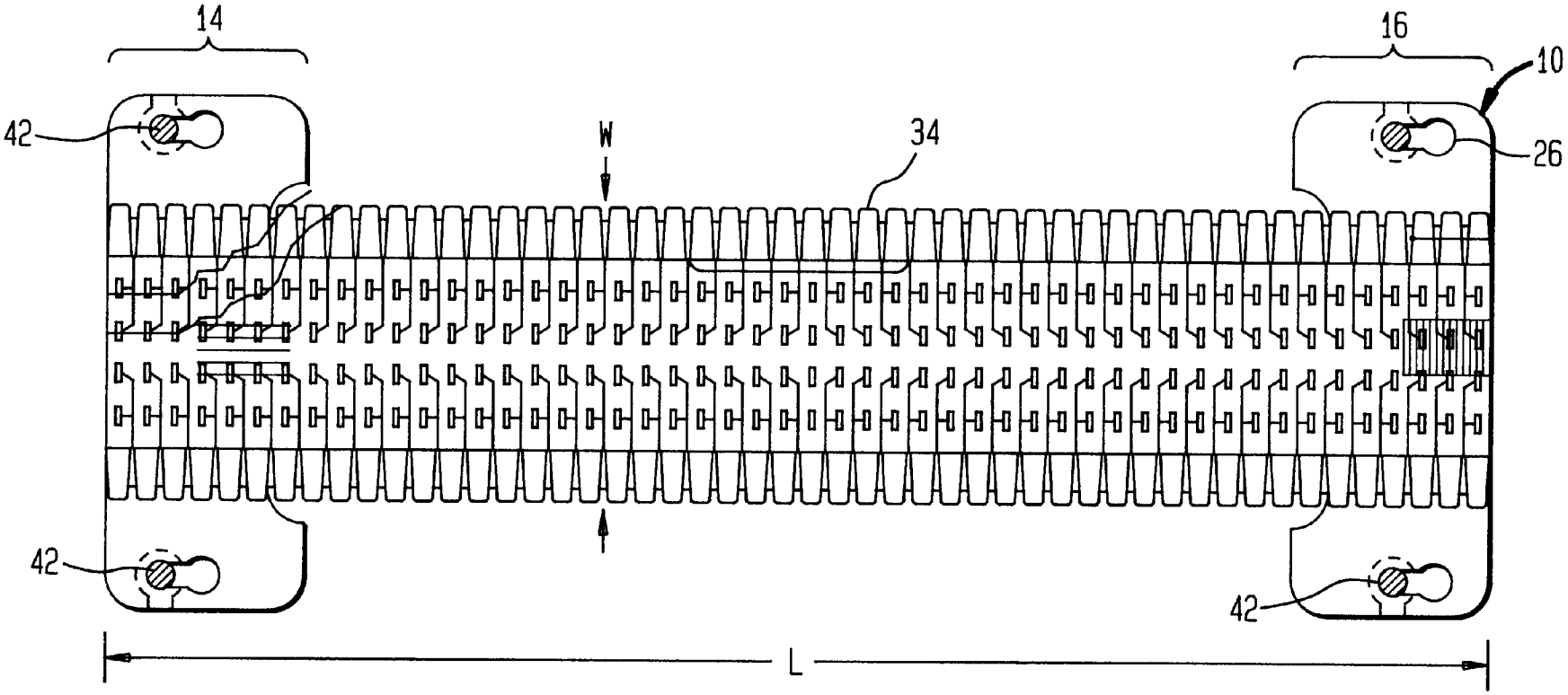
FIG. 3 is a top view of the embodiment of the present invention shown in FIG. 2.

Referring to FIG. 3, it can be seen that the length L of the bracket 10 is selected to generally match the length of the terminal array connector it supports. Furthermore, the width W of the mid-section 12 (FIG. 1) of the bracket 10 is selected to generally match the width of the terminal array connector 34 it supports. Only the top section 14 and the bottom section 16 of the bracket 10 are wider than the terminal array connector 34. The slotted apertures 26 used to mount the bracket 10 are contained in the areas of the bracket's top section 14 and bottom section 16 that extend beyond the terminal array connector 34. Anchor screws 42 pass through the slotted apertures 26, to connect the bracket to a mounting surface (not shown). The positioning of the slotted apertures on the wide areas of the bracket enables the anchor screws 42 to be easily accessed.

Figure 4:
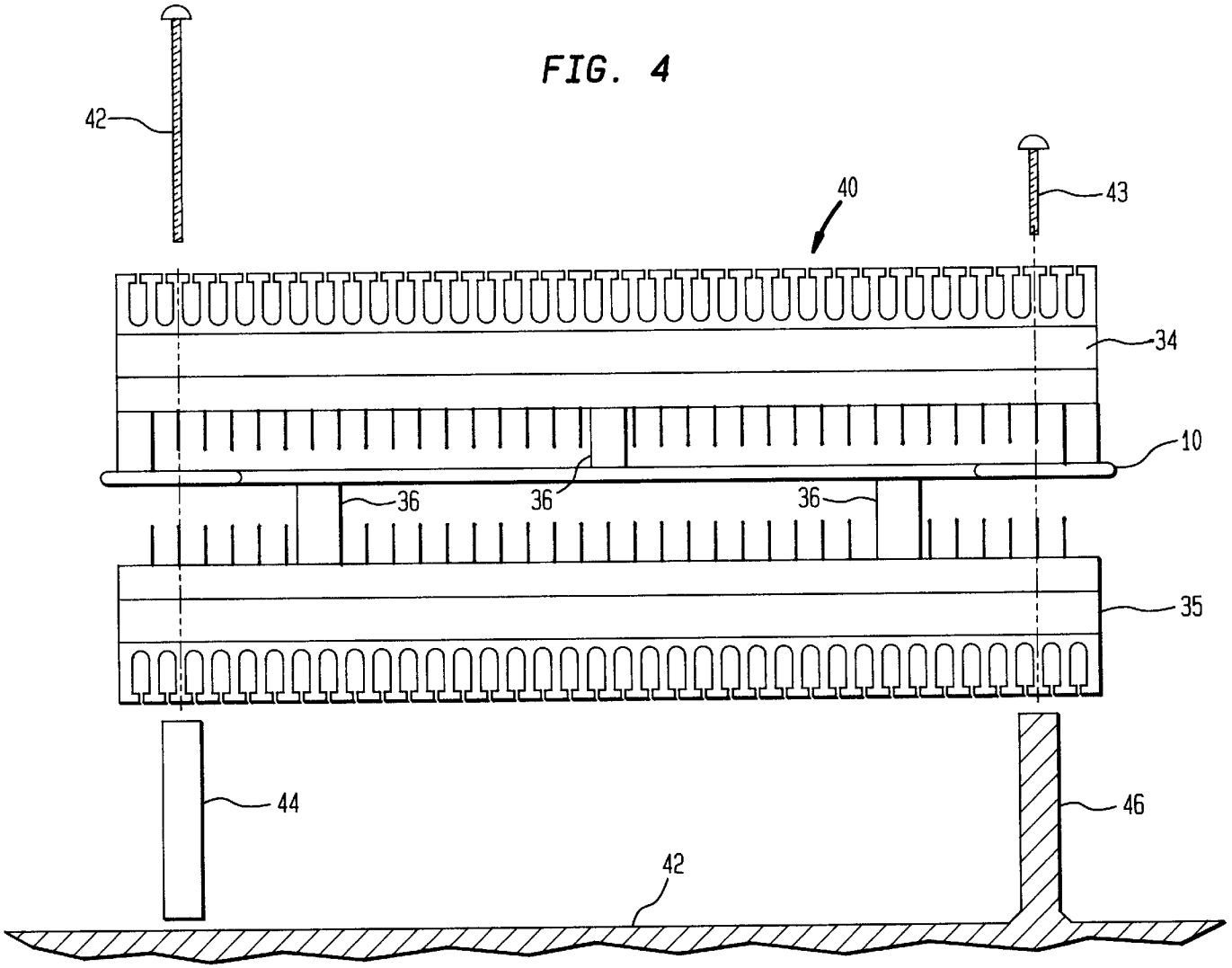
FIG. 4 is a side view of an embodiment of the present invention containing two wire connectors and shown in conjunction with two surface mounting systems.

Referring to FIG. 4, it can be seen that once a first terminal array connector 34 is mounted to a first side of the bracket 10, a second terminal array connector 35 can be attached to an opposite side of the same bracket 10. The second terminal array connector 35 is mounted to the bracket in the same manner as the first terminal array connector 34, for example, by using mounting screws and dielectric spacers 36. To prevent interference, the mounting screws used to attach the second terminal array connector 35 to the bracket 10 pass through different screw apertures 24 (FIG. 1) in the bracket 10 than do the mounting screws engaging the first terminal array connector 34.

The attachment of either one or two terminal array connectors to the bracket 10 produces a connector-bracket assembly 40. To mount the connector bracket assembly 40 to a mounting surface 42, one of two possible mounting systems is preferably used. The first mounting system involves the use of long anchor screws 42 and spacers 44. The spacers 44 are taller than the terminal array connector 35 is high. The spacer 44 is placed under the bracket 10 in the location of the slotted apertures 26 (FIG. 1). The long anchor screw 42 is then driven through the slotted aperture, past the bracket 10, through the spacer 44 and into the mounting surface 42. Since the spacers 44 are taller than the height of the second terminal array connector 35, the second terminal array connector 35 is supported a safe distance above the mounting surface 42.

To separate the connector-bracket assembly 40 from the mounting surface 42, the long anchor screw 42 need only be loosened slightly. The bracket 10 can then be manipulated so that the head of the long anchor screw 42 passes through the enlarged head region of the slotted aperture 26 (FIG. 1). To reattach the connector-bracket assembly 40, the method is reversed and the long anchor screw 42 is again tightened once the connector-bracket assembly 40 is in place.

A second mounting system for mounting the connector-bracket assembly 40 uses a post 46 that is formed as part of the mounting surface 42. In such a mounting system, only a short screw 43 is needed to attach the bracket 10 to the top of the post 46. Again, the short screw 43 will extend through the slotted apertures 26 (FIG. 1) in the bracket 10 so that the bracket 10 can be removed from the posts 46 just by loosening the screw 43.

Regardless of whether the connector-bracket assembly 40 sits upon a post 46 or a spacer 44, it will be understood that the connector-bracket assembly 40 can be attached to the mounting surface 42 with either the first terminal array connector 34 facing the mounting surface 42 or the second terminal array connector 35 facing the mounting surface. Accordingly, a technician can selectively orient the connector-bracket assembly 40 so that the terminal array connector being worked upon is facing upwardly.

By providing a bracket mounting system that retains two terminal array connectors in a stacked configuration, two terminal array connectors can now be mounted in the space previously required to mount a single terminal array connector. The density at which terminal array connectors can be mounted is increased two-fold.

It will be understood that the embodiments of the present invention specifically shown and described are merely exemplary and that a person skilled in the art can make alternate embodiments using different configurations and functionally equivalent components. For example, the number and location of the wire apertures and screw apertures within the bracket can be changed. Furthermore, the shape of the bracket used to support the terminal array connectors can also be changed. All such alternate embodiments are intended to be included in the scope of this invention as set forth in the following claims.

What is claimed is:

1. An assembly, comprising:

a terminal array connector having a predetermined length and a predetermined width;

a planar bracket having a first end section, a second end section and a middle section that extends between said first end section and said second end section, wherein said middle section has a width equivalent to said predetermined width and both said first end section and said second end section have a width that is wider than said predetermined width, said bracket further defining a plurality of wire apertures, and screw apertures that extend through said bracket from said first surface to said second surface;

at least one spacer disposed between said bracket and said terminal array connector, separating said terminal array connector from said bracket; and at least one mechanical fastener extending through one of said screw apertures in said bracket wherein said mechanical fastener attaches said bracket to said terminal array connector in a predetermined orientation where said middle section of said bracket is in alignment with said terminal array connector.

2. The assembly according to claim 1, wherein said terminal array connector has terminals that face said bracket when mounted to said bracket and said terminals are accessible through said wire apertures in said bracket.

3. The assembly according to claim 1, further including cable tie hoops on said bracket.

4. The assembly according to claim 1, wherein said first end section of said bracket and said second end section of said bracket contain areas that extend beyond said terminal array connector when said bracket is attached to said terminal array connector, and anchor apertures are defined by said bracket in said areas.

5. The assembly according to claim 1, wherein said bracket is generally I-shaped, having a top section and a bottom section connected by a narrower mid-section.

6. The assembly according to claim 1, wherein said bracket has a predetermined length that is equivalent to said predetermined length of said terminal array connector.

7. The assembly according to claim 6, wherein said mid-section of said bracket is generally equal in width to the width of said wire connector.

8. The assembly according to claim 5, wherein said anchor apertures are disposed at opposite sides of said top section of the bracket and said bottom section of said bracket.

9. The assembly according to claim 1, further including a second terminal array connector, wherein said first wire connector is coupled to said first surface of said bracket and said second wire assembly is coupled to said second surface of said bracket.

10. A mounting assembly, comprising;

a plurality of posts extending from a mounting surface;

a planar bracket having a first surface and a second surface, wherein said bracket is sized to abut against said plurality of posts when brought into contact therewith;

a first set of mechanical fasteners for connecting said bracket to said posts;

a first terminal array connector attached to said first surface of said bracket, wherein said first terminal array connector is supported above said posts by said bracket; and a second terminal array connector attached to said second surface of said bracket, wherein said second terminal array connector is supported between said posts by said bracket.

11. The assembly according to claim 10, further including spacers interposed between said terminal array connector and said bracket.

12. The assembly according to claim 10, wherein both said first terminal array connector and said second terminal array connector have terminals that face said bracket when mounted to said bracket and said bracket defines wire apertures that enable wires to pass through said bracket and couple to said terminals.

13. The assembly according to claim 12, further including cable tie hoops disposed on said bracket.

14. The assembly according to claim 10, wherein said bracket is generally I-shaped, having a top section and a bottom section connected by a narrower mid-section.

15. The assembly according to claim 10, wherein said second terminal array connector has a predetermined height and said posts are at least as long as said predetermined height.

16. A method of densely mounting terminal array connectors to a mounting surface, comprising the steps of:

providing a planar bracket having a first surface and an opposite second surface;

connecting a first terminal array connector to said first surface of said bracket;

connecting a second terminal array connector to said second surface of said bracket; and mounting said bracket to said mounting surface wherein said second wire connector is interposed between said bracket and said mounting surface.

17. The method according to claim 16, further including the steps of providing posts that extend from said mounting surface and mounting said bracket to said posts.

* * * * *